US010239103B2

(12) United States Patent
Sigloch et al.

(10) Patent No.: US 10,239,103 B2
(45) Date of Patent: Mar. 26, 2019

(54) MATERIAL TESTING METHOD, USE OF A DRAWING DIE ARRANGEMENT, AND DRAWING DIE ARRANGEMENT

(71) Applicants: SMS group GmbH, Duesseldorf (DE); Steffen Sigloch, Memphis, TN (US)

(72) Inventors: Steffen Sigloch, Memphis, TN (US); Thomas Winterfeldt, Willich (DE)

(73) Assignees: SMS group GmbH, Duesseldorf (DE); Steffen Sigloch, Memphis, TN (US)

( * ) Notice: Subject to any disclaimer, the term of this patent is extended or adjusted under 35 U.S.C. 154(b) by 132 days.

(21) Appl. No.: 14/533,164

(22) Filed: Nov. 5, 2014

(65) Prior Publication Data

US 2015/0314352 A1 Nov. 5, 2015

Related U.S. Application Data

(60) Provisional application No. 61/988,465, filed on May 5, 2014.

(51) Int. Cl.

| | |
|---|---|
| ***B21C 3/12*** | (2006.01) |
| ***B21C 1/00*** | (2006.01) |
| ***B21C 3/02*** | (2006.01) |
| ***B21C 51/00*** | (2006.01) |
| ***B21C 3/04*** | (2006.01) |

(52) U.S. Cl.

CPC ..... *B21C 3/12* (2013.01); *B21C 1/00* (2013.01); *B21C 3/02* (2013.01); *B21C 3/04* (2013.01); *B21C 51/00* (2013.01)

(58) Field of Classification Search

CPC .... B21C 1/22; B21C 1/24; B21C 3/04; B21C 3/12; B21C 3/14; B21C 47/3433; B21C 51/00; B21D 43/006

USPC ..... 72/17.3, 19.6, 19.7

See application file for complete search history.

(56) References Cited

U.S. PATENT DOCUMENTS

| | | | | |
|---|---|---|---|---|
| 3,782,154 | A * | 1/1974 | Fuchs, Jr. | B21C 3/06 72/19.6 |
| 4,196,607 | A | 4/1980 | Youtsey et al. | |
| 9,636,729 | B2 * | 5/2017 | Lutterbach | B21C 1/00 |
| 2010/0064750 | A1 | 3/2010 | Corder | |
| 2013/0269406 | A1 | 10/2013 | Corder | |

FOREIGN PATENT DOCUMENTS

| | | |
|---|---|---|
| DE | 29 12 996 C2 | 10/1979 |
| DE | 10 2009 039 873 A1 | 4/2010 |

OTHER PUBLICATIONS

Krautkrämer, Josef et al., "Ultrasonic Testing of Materials 4th Fully Revised Edition", 1990, pp. 167-169 and 239-240, Springer-Verlag Berlin Heidelberg GmbH.

* cited by examiner

*Primary Examiner* — Debra M Sullivan
(74) *Attorney, Agent, or Firm* — Collard & Roe, P.C.

(57) ABSTRACT

A method for material testing of an elongated work piece drawn through a drawing die arrangement, wherein the drawing die arrangement includes a drawing tool that acts on the elongated work piece, forming it in a forming region, carries out the material testing in the forming region.

6 Claims, 5 Drawing Sheets

MATERIAL TESTING METHOD, USE OF A DRAWING DIE ARRANGEMENT, AND DRAWING DIE ARRANGEMENT

CROSS REFERENCE TO RELATED APPLICATIONS

Applicants claim priority under 35 U.S.C. § 119(e) of U.S. Provisional Patent Application Ser. No. 61/988,465 filed on May 5, 2014, the disclosure of which is incorporated by reference.

BACKGROUND OF THE INVENTION

1. Field of the Invention

The invention relates to a method for material testing of an elongated work piece drawn through a drawing die arrangement, to the use of a drawing die arrangement, and to a drawing die arrangement.

2. Description of the Related Art

Such a drawing die arrangement is known from DE 10 2009 039 873 A1, whereby here, a drawing tool referred to as a drawing ring serves for shaping of the elongated work piece to be formed in the drawing method, in each instance. In particular, it is known from DE 10 2009 039 873 A1 to provide a material guide disposed ahead of the drawing ring, in each instance, in the drawing direction, by way of which the work piece to be drawn, in each instance, is fed to the drawing ring.

In the production of seamless pipes, using the drawing method, the work pieces to be drawn are configured in the form of hollow bodies. In this connection, a great technical challenge is presented in processing the work pieces during the drawing method so that the finished pipe or the finished drawn product has the most uniform possible mass distribution over the cross-section, or that the finished drawn product has a thickness expanse that remains as uniform as possible over the cross-section. For this purpose, it is proposed in DE 10 2009 039 873 A1 to configure a work piece guide disposed ahead of the drawing ring in the drawing direction—by way of which guide the work piece, in each instance, is fed to the drawing ring—so as to be displaceable relative to the drawing direction.

By suitable displacement of the work piece guide, and therefore ultimately also of the feed direction in which the work piece, in each instance, is fed to the drawing ring, the most uniform possible mass distribution can be made available in the drawn product to be produced by the drawing method, in that, for example, irregularities or uneven wall thicknesses or eccentricities of the work piece to be formed or shaped, in each instance, which can have an influence on the quality of the formed work piece, are evened out by suitable displacement of the work piece guide. In this connection, it is known from DE 10 2009 039 873 A1 to determine the displacement of the work piece guide, in each instance, that is required for the production of a drawn product having the most uniform possible mass distribution in cross-section, in that the mass distribution of the work piece material is measured in cross-section, and the work piece guide is displaced in accordance with the measured mass distribution. A corresponding measurement of the mass distribution is also disclosed by DE 29 12 996 C2.

Corresponding drawing die arrangements and drawing systems having drawing machines that draw the work pieces through the drawing die arrangement are also known for drawing rods, in other words for drawing elongated work pieces composed of a solid material. It makes little sense to measure a mass distribution here. Such a parameter is irrelevant for quality because solid material is involved.

Not only drawing of rods but also drawing of pipes, in other words drawing of all work pieces, generally involves processes that take place at the end of a production process, with regard to the semi-finished products produced, in each instance, in other words, for example, after casting and after rolling, and accordingly are considered part of final production. Here, in particular, material properties of the work pieces being processed are of significant importance, whereby suitable material testing methods or apparatuses, which allow statements about defects in the drawn, elongated work pieces, for example, cannot be found, specifically those that are suitable for the sector of drawn work pieces.

SUMMARY OF THE INVENTION

It is the task of the present invention to allow material testing in the case of drawn, elongated work pieces, particularly in the case of drawn rods.

In this connection, the invention proceeds from the fundamental recognition that material testing can take place in the forming region of drawn work pieces, in other words in the region in which the drawn material is subject to forming, although the material is subject to great changes specifically in the forming region. Proceeding from this fundamental recognition, material testing methods, uses of a drawing die arrangement, and drawing die arrangements having the characteristics of the invention are proposed as concrete solutions. Further advantageous embodiments are found in the following description.

In particular, a method for material testing of an elongated work piece drawn through a drawing die arrangement, wherein the drawing die arrangement comprises a drawing tool that acts on the elongated work piece, forming it in a forming region, can be characterized in that the material testing is carried out in the forming region.

In this connection, a measurement device can particularly be disposed on the drawing tool, so that the measurement device comes into particularly intimate contact with the work piece by way of the drawing tool, which in turn specifically allows a correspondingly precise measurement, without any additional measures.

In particular, a corresponding material testing method can easily take place over the entire length of the drawn work piece, if desired, so that a very good statement concerning the drawn material can be made.

For example, measurement devices are known from DE 10 2009 039 873 A1 and DE 29 12 996 C2, which measure the mass distribution of the work piece material; in the case of the arrangements disclosed there, time measurements are run on walls of the pipes used as work pieces.

In this regard, these measurement devices, which measure the mass distribution of the work piece material, can be used for material testing. This material testing can be implemented, for example, in that an attenuation is used as a parameter for the material quality.

Accordingly, a drawing die arrangement having a drawing tool that acts on an elongated work piece, forming it in a forming region, and having a drawing tool support that carries the drawing tool and counteracts the drawing tool, as well as having a measurement device that measures the mass distribution of the work piece material, can be used for material testing of the elongated work piece drawn through the drawing die arrangement.

In this connection, it can be assumed, according to the previous recognitions, that in the case of thin-walled pipes, an attenuation of the signal, in each instance, dependent on the quality of the pipe material will be very difficult to determine, because a signal passes through only a thin material layer. The situation is different for thick-walled pipes or for rods, in which a measurement signal passes through thicker material layers and therefore significant changes can be expected. Particularly in the case of rods, measurements of mass distribution as such do not make any sense, because ultimately, they are subject to simple symmetry questions as a result of the drawing tool. The measurement devices that serve for measuring mass distribution in the case of pipes, however, can be utilized for material testing of drawn rods without further structural measures, if corresponding drawing tools are used or utilized for drawing of rods.

If the measurement device is disposed on the drawing tool, then the measurement device comes into particularly intimate contact with the work piece, which in turn specifically allows a correspondingly precise measurement, without further measures.

The material testing method described above and the use of a drawing die arrangement described above are particularly suitable for material testing on rods, because here, a particularly informational measurement signal can be expected because of the work piece geometry.

Accordingly, a drawing die arrangement having a drawing tool that acts on a rod, forming it in a forming region, and having a drawing tool support that carries the drawing tool and counteracts the drawing tool, as well as having a measurement device that acts to measure in the forming region is advantageous. Such a measurement device carries out measurements in a region of the rod that particularly stands under stress, which measurements are then correspondingly informational. Also, the entire drawn rod can be detected, measuring it accordingly, by means of the measurement on the drawn rod or by means of the measurement on the rod during drawing, without further complex measures.

In particular, the measurement device can comprise means for determining an attenuation of a measurement signal that runs through the work piece, thereby making it possible to detect material properties in relatively uncomplicated manner. Thus, for example, X-rays, ultrasound or millimeter waves or microwaves can provide information about material properties, on the basis of their attenuation, for example information concerning a defect density or concerning variations in concentrations or the like.

Preferably, the measurement signal is reflected on a wall of the work piece, so that the measurement distance is doubled accordingly, which ultimately increases the informational value of the measurement signal accordingly. Likewise, the overall arrangement can then be built in relatively simple manner, because the transmitter and receiver of the measurement signal lie on one side, in each instance, and can actually be configured in one structural unit, if necessary.

Particularly preferably, the material testing is carried out by means of ultrasound. Using ultrasound facilitates structural implementation, because corresponding ultrasound measurements are already known as measurements for mass distribution in pipes, so that ultimately, only minimal changes have to be made structurally. In general, it will be sufficient to merely adapt the measurement signal evaluation accordingly, for example, in that an attenuation measurement is integrated in place of or supplemental to a running time measurement, for example.

Ultimately, the material testing can be directed at any interesting material parameter of the work piece, in each instance, such as, for example, the presence and/or distribution of specific chemical elements, a material density, the number of defects or the like, to the extent that a measurement signal can be changed in sufficiently significant manner by means of the material parameter, in each instance. The material testing methods, uses of a drawing die arrangement or a drawing die arrangement described above appear to be particularly suitable for a defect measurement, in particular, whereby defects have a particularly attenuating effect on ultrasound that is passed through the material. Because reflections in a statistical direction take place at the defects, the measurement signal may be attenuated accordingly. Preferably, the attenuation of other signal parameters, such as a running time, for example, are not influenced by the attenuation caused by the defects, so that the latter other signal parameters are still available for other measurement purposes, if necessary, or then no longer need to be detected using measurement technology.

Thus, it can be provided, in the case of a drawing die arrangement having a drawing tool that acts on an elongated work piece and having a drawing tool support that carries the drawing tool and counteracts the drawing tool, in which a measurement device that measures the mass distribution of the work piece and/or tests the material of the work piece is disposed on the drawing tool, that a coupling medium that is guided in circulation is provided between the measurement device and the drawing tool. A significantly better or more precise measurement by the measurement device can be made possible as a result of the coupling medium provided. It can advantageously be ensured, by providing the circulation for guiding the coupling medium, that coupling medium is constantly present between the measurement device and the drawing tool, thereby making it possible to increase the measurement accuracy, which thereby increases the informational value of the measurement signal accordingly, or makes it possible in the first place.

Preferably, a circulation channel for the coupling medium is provided in the drawing tool support. The coupling medium can be accommodated in this channel to implement reliably guided circulation. A pump can be present to make the circulation of the coupling medium available.

In order to be able to undertake a precise or better measurement, a coupling medium having a higher viscosity than a drawing oil used for drawing the work piece can be provided between the measurement device and the drawing tool, in the case of a drawing die arrangement having a drawing tool that acts on an elongated work piece and having a drawing tool support that carries the drawing tool and counteracts the drawing tool or the work piece, in which a measurement device that measures the mass distribution of the work piece material and/or tests the material of the work piece is disposed on the drawing tool.

The precision or quality of the measurement can be significantly improved by means of providing a coupling medium having a lower viscosity than the drawing oil used for drawing the work piece. On the other hand, a drawing oil used for drawing the work piece is suitable only in very limited manner as a coupling medium for a measurement device, because of its higher viscosity, particularly if the distance between measurement device and drawing tool is supposed to be selected to be as small as possible, for reasons of great measurement accuracy. This principle holds true all the more if the coupling medium is supposed to be guided in circulation and also to get into the narrow gap between measurement device and drawing tool.

Precise or better measurement of the mass distribution and/or material testing of the work piece material can also be implemented by means of a drawing die arrangement having a drawing tool that acts on an elongated work piece and having a drawing tool support that carries the drawing tool and counteracts the drawing tool, in which a measurement device that measures the mass distribution of the work piece material and/or tests the material of the work piece is disposed on the drawing tool, which arrangement is characterized in that an accommodation opening for the measurement device is provided in the drawing tool support. By means of providing the accommodation opening, a better measurement can be implemented in that the distance between the measurement device and the inner wall of the drawing tool can be freely selected. In this regard, the distance can be adapted to the running times of a measurement signal or to similar general geometric conditions, in order to obtain optimal measurement results in this manner.

Preferably, the drawing tool support can comprise a drawing ring that lies against the drawing tool, whereby the accommodation opening is provided on the drawing ring. By means of providing the accommodation opening on a drawing ring that lies against the drawing tool, the measurement device can be positioned in the immediate vicinity of the drawing tool, to advantageously achieve a precise measurement.

Cumulatively or alternatively, a depression or an accommodation opening can also be provided on the drawing tool, in order to accommodate an end section of a measurement device that might be accommodated in an accommodation opening of the drawing ring in the drawing tool. In this way, it becomes possible to implement a very slight distance between the inner wall of the drawing tool and the measurement device, accompanied by achieving a very precise measurement.

Preferably, the accommodation opening can radially penetrate the drawing tool support, the drawing ring or the drawing tool, and/or a seal can be disposed between the measurement device and the drawing tool support, the drawing ring or the drawing tool. Providing the seal brings with it the advantage that the coupling medium can be effectively prevented from exiting, while the radially oriented accommodation opening can be made available in simple and operationally reliable manner.

To prevent exit of the coupling medium, a seal can preferably also be disposed between the drawing tool support and the drawing tool.

Preferably, the drawing tool support and the drawing tool can be connected with one another by means of a press-fit connection and/or a shrink-fit connection. In this manner, it is advantageously possible to do without the use of a separate seal to produce tightness, if applicable, if tightness can already be made available by means of the press-fit connection and/or the shrink-fit connection.

In order to be able to implement better or precise measurement of the mass distribution or material testing of the work piece material, a drawing die arrangement having a drawing tool that acts on an elongated work piece and having a drawing tool support that carries the drawing tool and counteracts the drawing tool, in which arrangement a measurement device that measures the mass distribution of the work piece material and/or tests the material of the work piece is disposed on the drawing tool, can be provided. This arrangement is characterized in that a spacer that defines a space for coupling medium is provided between the measurement device and the drawing tool. If applicable, this space defined by the spacer represents merely a gap.

Very precise and very interference-free measurement of the mass distribution or material testing of the work piece material by means of the measurement device can be implemented by providing the spacer that defines a space for the coupling medium, in that very defined coupling of the measurement device to the coupling medium is possible by means of providing the space for the coupling medium. Also, the space for the coupling medium allows a defined flow when, as has already been explained above, the coupling medium is provided to circulate. The spacer can preferably comprise a spacer ring or a partial spacer ring.

In particularly practical manner, the space for the coupling medium can be worked out on the measurement device or the drawing tool, and the spacer can be formed by a remaining protrusion of the measurement device. The spacer is particularly preferably configured in one piece with the measurement device. A spacer configured in one piece with the measurement device can advantageously be produced, in simple and practical manner, by means of a milling or chip-cutting method and/or by means of erosion of a hard metal, for example. The protrusion can particularly be situated on a test head of the measurement device.

Very precise measurement of the mass distribution and/or material testing of the work piece material can also be implemented with a drawing die arrangement having a drawing tool that acts on an elongated work piece and having a drawing tool support that carries the drawing tool and counteracts the drawing tool. In this arrangement a measurement device that measures the mass distribution of the work piece material and/or tests the material of the work piece is disposed on the drawing tool. This arrangement is characterized in that a clamping apparatus for the measurement device that acts in the direction toward the drawing tool is provided on the drawing tool support.

Very precise positioning of the measurement device is possible by means of the clamping apparatus, of course accompanied by very precise measurement, in which error influences as the result of undesired positioning of the measurement device are effectively suppressed. The clamping apparatus is advantageously provided on the drawing tool support and not on the drawing tool, since providing a clamping apparatus on the drawing tool would be possible, in practical terms, only in very complicated manner, as a consequence of the very hard material that must be provided for the drawing tool.

To achieve very effective, defined bracing of the measurement device, the clamping apparatus preferably comprises a three-point bracing mechanism.

Precise measurement of the mass distribution and/or material testing of the work piece material can also be implemented by means of a drawing die arrangement having a drawing tool that acts on an elongated work piece and having a drawing tool support that carries the drawing tool and counteracts the drawing tool, in which arrangement a measurement device that measures the mass distribution of the work piece material and/or tests the material of the work piece is disposed on the drawing tool. This arrangement is characterized in that the measurement device is directed at a region that lies behind the drawing and ironing section of the drawing die arrangement, in the drawing direction, and/or at a cylindrical region of the drawing tool or a drawing mandrel.

It has been shown that in these regions, very precise measurement of the mass distribution and/or material testing of the work piece material is possible, and this precision in turn results in a corresponding quality of the formed work piece.

Particularly preferably, in this connection, the measurement device is focused on the region of the drawing arrangement that lies behind the drawing and ironing section, in the drawing direction, or on the cylindrical region, in order to optimize the quality of the measurement.

As has already been explained above, the quality of the formed work piece can be improved or its material can be tested also by means of a drawing system having a drawing machine having a drawing die arrangement explained above, through which the drawing machine draws a work piece, and having an above work piece guide disposed ahead of the drawing die arrangement, in the drawing direction.

It is understood that the characteristics of the solutions described above and in the claims, respectively, can also be combined, if necessary, in order to be able to implement the advantages cumulatively, accordingly.

BRIEF DESCRIPTION OF THE DRAWINGS

Further advantages, goals, and properties of the present invention will be explained using the following description of exemplary embodiments, which are particularly shown also in the attached drawings. The drawings show.

DETAILED DESCRIPTION OF PREFERRED EMBODIMENTS

Figure 1:
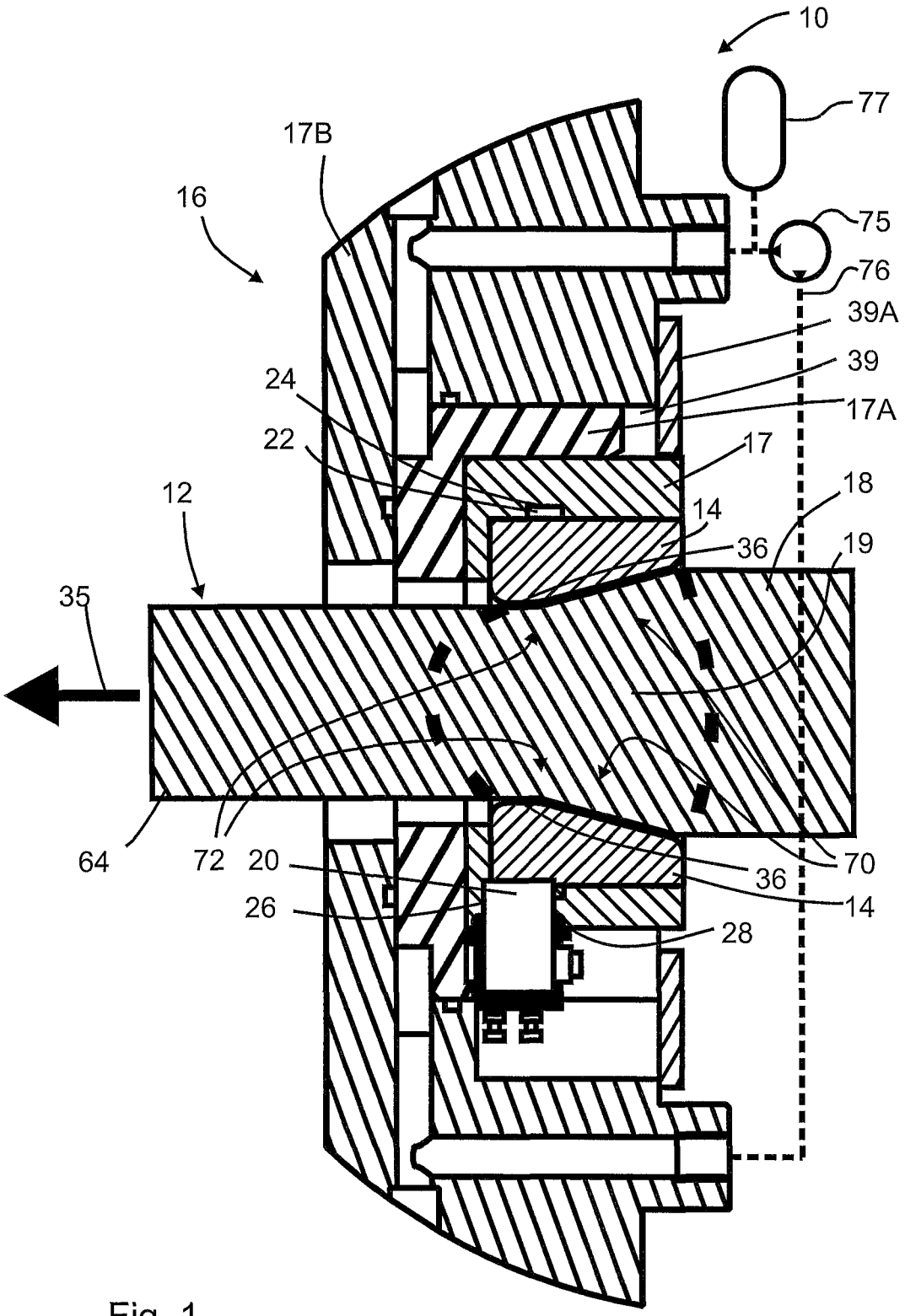
FIG. 1 a sectional representation of a drawing die arrangement.

The drawing die arrangement 10 shown in FIG. 1 comprises a drawing tool 14, which is provided for acting on an elongated work piece 12. The drawing die arrangement 10 furthermore comprises a drawing tool support 16 that carries the drawing tool 14 and counteracts the drawing tool 14, in which a measurement device 20 that measures the mass distribution of the work piece material 18 is disposed on the drawing tool 14, which device is able to measure the mass distribution of the work piece material in a pipe to be drawn as the work piece 12. The drawing tool support 16 is configured in multiple parts and comprises an adapter ring 17A, a drawing ring holder 17B in the form of a spherical cap, and a drawing ring 17 that lies against the drawing tool 14.

A coupling medium 22 that is guided in circulation is provided between the measurement device 20 and the drawing tool 14. A circulation channel 24 for the coupling medium 22 is provided in the drawing tool support 16, so that the coupling medium 22 can be guided in circulation via the circulation channel 24 or can be moved to circulate via the circulation channel 24. It is understood that the circulation channel 24 of this exemplary embodiment is connected, in sufficiently known manner, with a pump 75 and with a coupling medium supply 77, by way of feed and discharge lines 76.

The measurement device 20 of this exemplary embodiment comprises an ultrasound sensor that is partially accommodated in an accommodation opening 26 provided in the drawing ring 17 of the drawing tool support 16. In other embodiments, other types of sensors, for example X-ray sensors, can also be used.

The accommodation opening 26 for the measurement device penetrates the drawing tool support 16 radially or in a radial direction. A seal 28 is disposed between the measurement device 20 and the drawing tool support 16.

Figure 2A:
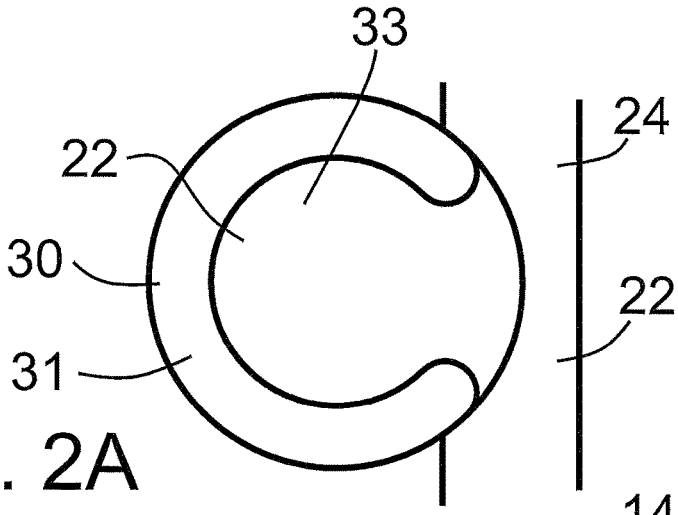
FIG. 2A the measurement device according to FIG. 2 in a schematic view from below.
Figure 2:
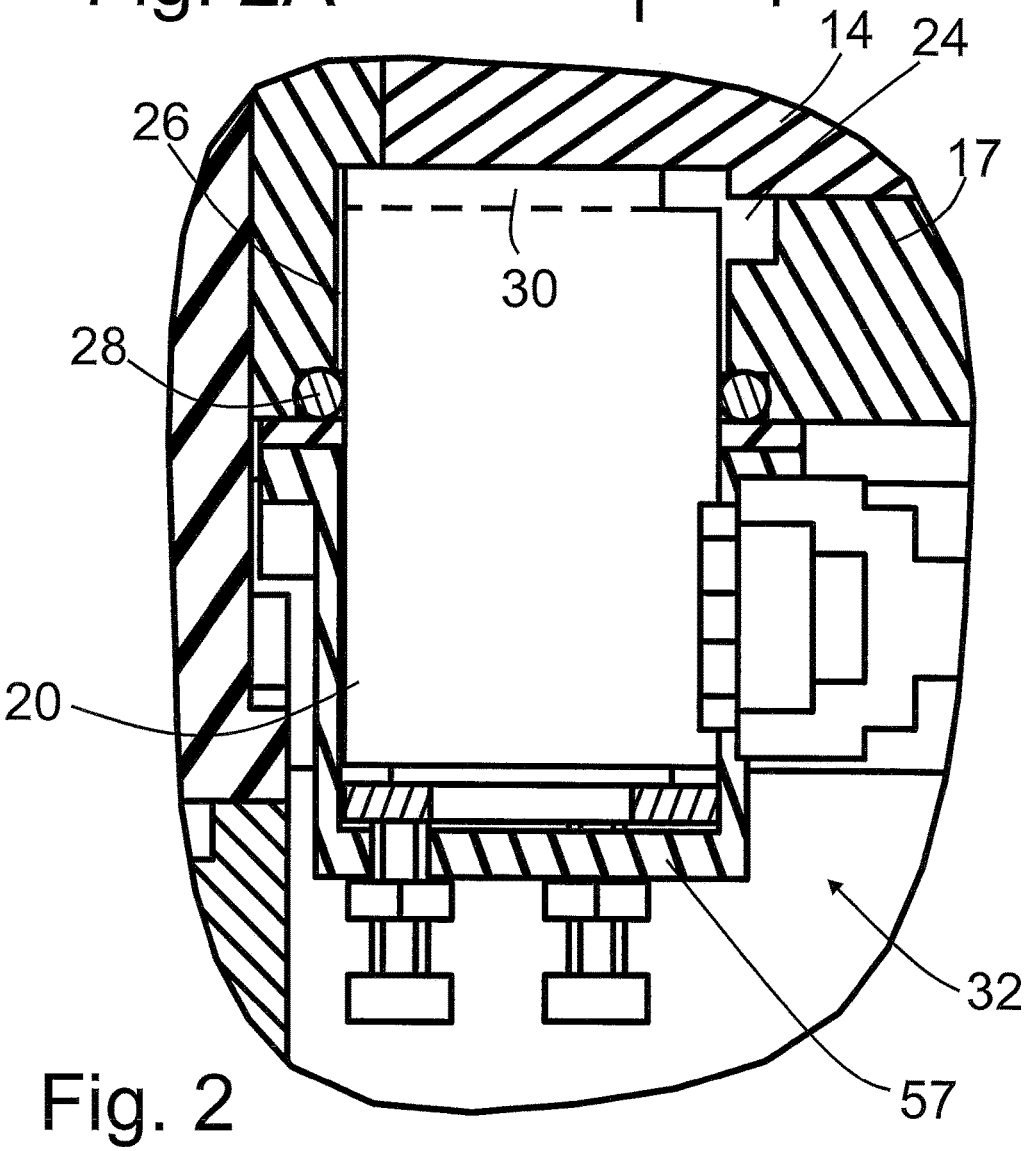
FIG. 2 an enlarged representation of a detail of FIG. 1, which particularly shows a measurement device of the drawing die arrangement.

Not shown in FIG. 1 but evident in FIG. 2 is that a spacer 30, which defines a space 33 for the coupling medium 22 (see FIG. 2A), is provided between the measurement device 20 and the drawing tool 14.

The space 33 for the coupling medium 22 is worked out on the measurement device 20, whereby the spacer 30 is formed by a remaining protrusion 31 of the measurement device 20. Accordingly, the spacer 30 is configured in one piece with the measurement device 20 in the exemplary embodiment illustrated here.

Figure 3:
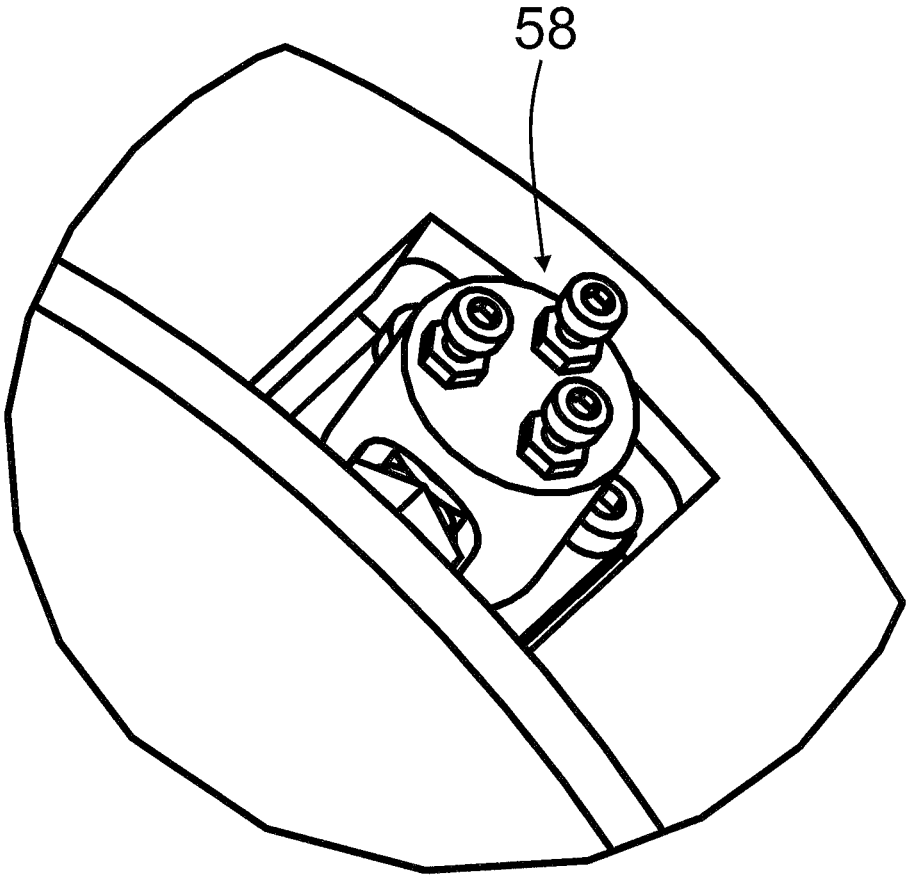
FIG. 3 a three-dimensional representation of the measurement device, in a perspective from which the configuration of the face region of the measurement device is evident in greater detail.
Figure 4:
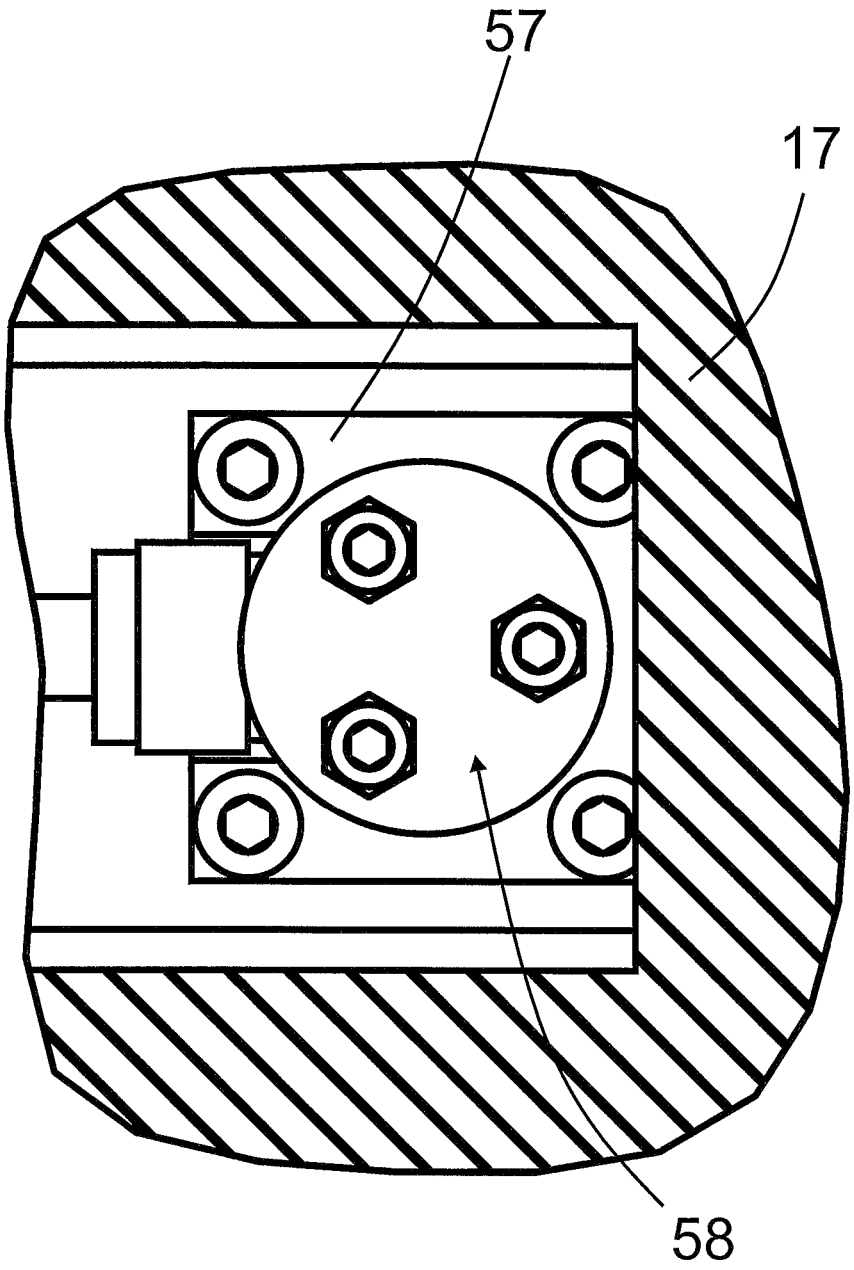
FIG. 4 a top view of the measurement device.

A clamping apparatus 32 for the measurement device 20 that acts in the direction toward the drawing tool 14 is provided on the drawing tool support 16 (see FIG. 2), whereby the clamping apparatus 32 comprises a U-shaped clamping element 57 and three-point bracing mechanism 58 (see FIG. 3), which has three screw connections, in each instance. The U-shaped clamping element 57 is screwed onto the drawing ring 17 via four screws (see FIG. 4).

As is evident from FIG. 1, the measurement device 20 is particularly directed at a region that lies behind a drawing and ironing section of the drawing die arrangement 10, in the drawing direction 35, and is particularly also focused in the direction of this region.

FIG. 1 illustrates the situation for forming a rod 64 by means of drawing, whereby pipes can also be drawn, if applicable, as work pieces 12, with or without a mandrel, and a mandrel is not shown in the figures. The use of a mandrel is particularly advantageous in application cases in which a very uniform wall thickness stands in the foreground, and is sufficiently known as such from the state of the art.

The forming process during drawing can be divided into two regions, namely the reduction drawing component and the drawing and ironing component or the reduction drawing section 70 and the drawing and ironing section 72 (see FIG. 1). In the reduction drawing section 70, the work piece 12 is reduced to the desired outside diameter. The drawing and ironing section 72 begins starting from the point at which the drawing tool 14 demonstrates no further narrowing in the drawing direction 35; it extends in the drawing direction 35 up to the point at which no further forming takes place any longer. The drawing tool 14 has a cylindrical region 36. The drawing and ironing section 72 is defined by this region.

The drawing die arrangement 10 furthermore has a cable channel 39 covered by a covering 39A for guiding a measurement line or a supply line for the measurement device 20 in from outside the drawing die arrangement 10. Likewise, the drawing tool support comprises further known and therefore not numbered channels for coolants, whereby the division of the drawing tool support 16 essentially represents facilitation of production in this regard.

Figure 5:
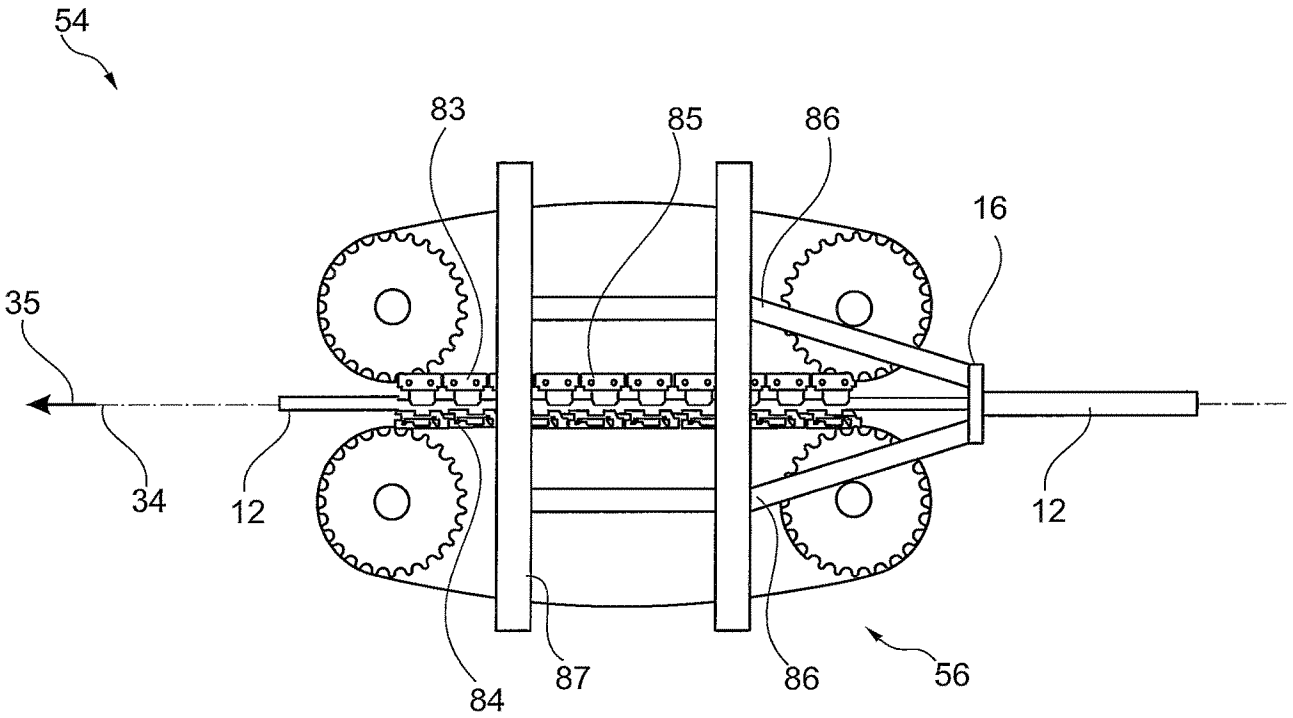
FIG. 5 a schematic side view of a drawing system.

The drawing die arrangement shown in FIGS. 1 to 4 can be integrated into a drawing machine 56 (see FIG. 5) by way of the drawing tool support 16, to produce a drawing system 54. In this exemplary embodiment, the drawing machine 56 is structured as a caterpillar tractor. Alternatively, the drawing machine 56 can also be configured in the form of a two-carriage drawing machine or a drum drawing machine, for example.

In this connection, the drawing machine 56 draws the work piece 12 through the drawing tool 14 in the drawing direction 35, along a drawing axis 34, by way of two drawing chains 83 and 84 (shown schematically) and gripping drawing tools 85 carried on these drawing chains 83, 84; the tool supports itself against the tool support 16 by way of supports 86, on a frame rack 87 that carries the drawing chains 83, 84.

An ultrasound signal or a different signal can easily be introduced into a forming region 19 of the work piece 12 by means of the measurement device 20, and evaluated using measurement technology. The attenuation of the signal can be evaluated as a measurement signal for the number of defects in the material 18 of the work piece 12. When using pipes as work pieces 12, the wall thickness of the pipes can be measured, if necessary; this measurement can serve, for example, for measurement of the mass distribution, whereby the wall thickness measurement will then generally take place by way of running time measurements. Here, too, the signal strength of the attenuation might possibly be sufficient to be able to check for defects as a material parameter.

Very good data about the work piece material 18 can be measured by means of the measurement in the forming region 19. The measurements are extremely effective on the basis of the good coupling of the measurement devices 20 to the work piece 12. The measurements are extremely effective particularly on the basis of the good coupling between measurement device 20 and drawing tool 14, on the one hand, and/or on the basis of the good coupling between drawing tool 14 and the work piece, on the other hand.

Although only a few embodiments of the present invention have been shown and described, it is to be understood that many changes and modifications may be made thereunto without departing form the spirit and scope of the invention.

What is claimed is:

1. A material testing method for material testing of a solid rod comprising:

(a) providing a drawing die arrangement having a drawing tool support that carries a drawing tool and counteracts the drawing tool and a mass distribution measurement device;

(b) drawing the solid rod through the drawing die arrangement to cause the drawing tool to act on and shape the solid rod in a forming region of the drawing die arrangement;

(c) sending a measurement signal from the measurement device of the drawing die arrangement through the solid rod in the forming region of the drawing die arrangement;

(d) receiving the measurement signal;

(e) measuring via the measurement device an attenuation of signal strength of the measurement signal after the measurement signal passes through the solid rod; and (f) evaluating via the measurement device the attenuation such that local defects in the solid rod are identified.

2. The material method according to claim 1, wherein the measurement device is disposed on the drawing tool.

3. The material testing method according to claim 1, wherein the measurement signal is reflected on a wall of the solid rod.

4. The material testing method according to claim 3, wherein the measurement signal comprises ultrasound.

5. A drawing die system comprising:

(a) a solid rod; and (b) a drawing die arrangement comprising:

(i) a drawing tool adapted to act on the solid rod and shape the solid rod in a forming region of the drawing die arrangement as the solid rod is drawn through the drawing die arrangement;

(ii) a drawing tool support carrying the drawing tool and counteracting the drawing tool; and (iii) a measurement device acting to measure in the forming region of the drawing die arrangement, the measurement device comprising an attenuation determination device configured to transmit a measurement signal, to receive the measurement signal, to measure an attenuation of signal strength of the measurement signal after the measurement signal passes through the solid rod, and to evaluate the attenuation such that local defects in the solid rod are identified.

6. The drawing die system according to claim 5, wherein the measurement signal is reflected on a wall of the solid rod.

* * * * *